US007086926B2

(12) United States Patent
Falla

(10) Patent No.: US 7,086,926 B2
(45) **Date of Patent: *Aug. 8, 2006**

(54) BRASSIERE SHOULDER STRAP PAD

(75) Inventor: Gloria Falla, Demarest, NJ (US)

(73) Assignee: Playtex Products, Inc., Westport, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/702,103

(22) Filed: Nov. 5, 2003

(65) Prior Publication Data

US 2004/0134602 A1 Jul. 15, 2004

Related U.S. Application Data

(63) Continuation-in-part of application No. 10/108,761, filed on Mar. 28, 2002, now abandoned, and a continuation-in-part of application No. 10/108,764, filed on Mar. 28, 2002, now abandoned, which is a continuation-in-part of application No. 09/896,049, filed on Jun. 29, 2001, now abandoned, which is a continuation of application No. 08/792,059, filed on Feb. 3, 1997, now abandoned, which is a continuation of application No. 08/553,853, filed on Nov. 6, 1995, now abandoned, which is a continuation of application No. 08/162,537, filed on Dec. 3, 1993, now Pat. No. 5,507,681.

(51) Int. Cl.
*A41D 27/26* (2006.01)

(52) U.S. Cl. ..... 450/93; 450/41; 450/86; 450/92; 2/267

(58) Field of Classification Search ..... 428/317.1; 450/41, 92, 93, 86; 156/251, 257, 265, 268, 156/270, 292, 300, 301, 302; 2/267
See application file for complete search history.

(56) References Cited

U.S. PATENT DOCUMENTS

| | | | | |
|---|---|---|---|---|
| 3,588,913 | A | 6/1971 | Ewing | 0/267 |
| 4,472,838 | A | 9/1984 | Pompa | 2/268 |
| 4,575,874 | A | 3/1986 | Johmson | 2/268 |
| 4,612,935 | A | 9/1986 | Greifer | 128/510 |
| 4,795,399 | A | 1/1989 | Davis | 450/86 |
| 4,887,318 | A | 12/1989 | Weinreb | 2/268 |
| 4,945,576 | A | 8/1990 | Melton | 2/268 |
| 5,388,743 | A | 2/1995 | Silgay | 224/264 |
| 5,445,858 | A | 8/1995 | Nwoko | 128/71 |
| 5,474,487 | A | 12/1995 | Roush et al. | 450/86 |

(Continued)

*Primary Examiner*—Linda Gray
(74) *Attorney, Agent, or Firm*—Ohlandt, Greeley, Ruggiero & Perle, L.L.P.

(57) ABSTRACT

A shoulder strap pad assembly is provided that includes: a top cover, a bottom cover, and a cushion filler. The bottom cover is laminated to the top cover to form an enclosure in which the cushion filler is secured. The top cover has a top fabric layer, a first adhesive web layer positioned below the top fabric layer and a first base layer positioned below the first adhesive layer on a side opposite that of the top fabric layer. The bottom cover has a second base layer, a second adhesive web layer positioned above the second base layer. The cushion filler has a cushion layer, a third adhesive web layer positioned above the cushion layer, a fourth adhesive web layer positioned below the cushion layer, and a third base layer positioned below the fourth adhesive web layer. In a preferred embodiment, the pad assembly is attached to a piece of fabric to form a channel in which a brassiere shoulder strap is positioned. In a alternative embodiment, the pad assembly is integrally formed with the brassiere shoulder strap.

1 Claim, 3 Drawing Sheets

U.S. PATENT DOCUMENTS 5,507,764 A 4/1996 Muller ..... 450/86
5,539,931 A 7/1996 Fizer et al. ..... 2/268
5,558,556 A 9/1996 Froehlich ..... 450/86
5,566,871 A 10/1996 Weintraub ..... 224/264
5,626,507 A 5/1997 Gillen ..... 450/86
5,803,792 A 9/1998 Roush et al. ..... 450/86
5,913,413 A 6/1999 Huyck ..... 2/459
5,984,764 A 11/1999 Tedeschi et al. ..... 450/86

BRASSIERE SHOULDER STRAP PAD

RELATED APPLICATIONS

This application is a continuation-in-part of U.S. application Ser. No. 10/108,761 filed Mar. 28, 2002 now abandoned and U.S. application Ser. No. 10/108,764 filed Mar. 28, 2002, now abandoned which is a continuation-in-part of application Ser. No. 09/896,049, filed Jun. 29, 2001, now abandoned which is a continuation of application Ser. No. 08/792,059, filed Feb. 3, 1997, now abandoned which is a continuation of application Ser. No. 08/553,853, filed Nov. 6, 1995, now abandoned which is a continuation of application Ser. No. 08/162,537, filed Dec. 3, 1993, now U.S. Pat. No. 5,507,681.

BACKGROUND OF THE INVENTION

1. Field of the Invention

The present invention relates generally to a shoulder strap pad. More particularly, the present invention relates to a shoulder strap pad for use in a brassiere shoulder strap that is positionable or moveable.

2. Description of the Prior Art

A well known problem associated with a brassiere shoulder strap is the discomfort caused by the strap on the shoulder of the wearer. Specifically, each brassiere strap will normally cause either a depression or irritation in the shoulder and may even interfere with arterial or venous drainage. Numerous attempts have been made to relieve this discomfort. Some attempts have included use of shoulder pads of cotton or foam or rubber that are interposed between the strap and the wearer's shoulder, and some are releasably attachable to the strap.

Significantly, such pads have proven to be bulky and unsightly. Also, there are inconveniences attendant with such attachments since such pads will normally need to be removed, and subsequently reattached, each time the brassiere is washed.

Some brassiere straps have attempted to incorporate a pad structure in the strap itself. Such brassiere straps may have achieved a modicum of success in relieving discomfort. However, such brassieres have limited user life since they fail to maintain their desired appearance after several machine washings apparently due to the effect cleaning detergents have on the construction and materials of the brassiere strap. For example, pads and straps made of foam have been found to yellow after a few washings. It is also common that brassieres that have incorporated a pad therein have a knotted or bumpy appearance after repeated machine washings.

Other attempts to relieve discomfort, yet provide a modicum of pleasing appearance, have included widening the shoulder strap to better distribute the weight in the shoulder area. Still other attempts have been to incorporate elastic bands with a padded cover in the strap to provide more flexibility and thus attempt to better distribute the pressure in the shoulder area.

All such attempts have, heretofore, failed to achieve the desired results, namely relief of the discomfort in the shoulder area, with a smooth attractive appearance that is maintained even after repeated wear and machine washing. Thus, long wear life and comfort have evaded prior art shoulder straps.

SUMMARY OF THE INVENTION

It is an object of the present invention to provide a shoulder strap pad that alleviates discomfort and irritation.

It is another object of the present invention to provide a shoulder strap pad that has an attractive, non-bulky appearance.

It is a further object of the present invention to provide such a shoulder strap pad that is made of materials and constructed to achieve long wear life.

It is also an object of the present invention to provide a shoulder strap pad that is movable along the shoulder strap of a brassiere.

It is another object of the present invention to provide a shoulder strap pad that is positionable along the strap, and thus anywhere along the shoulder of a wearer.

It is still another object of the present invention to provide a shoulder strap pad that may be utilized by wearers of varying body types.

It is yet another object of the present invention to provide a shoulder strap pad that has that conforms to the anatomy of the shoulder area of the wearer.

These and other objects and advantages of the present invention are achieved by a shoulder strap pad having a pad assembly and a fabric cover. The fabric cover is connected to the pad assembly along each side or axial edge by a binder to form an opening or channel therebetween. The shoulder strap of the brassiere is positioned in the channel formed by the fabric cover and the pad assembly. The shoulder strap pad is movably positionable anywhere along the shoulder strap of the brassiere, thereby maximizing the comfort level provided to the wearer. The fabric cover has a first end positioned toward the front of the wearer and a second end positioned toward the back of the wearer. The first or front end is cut along a diagonal on one end to provide a larger opening for receipt of a brassiere shoulder strap. This diagonal first end also facilitates easier movement of the shoulder strap pad along the brassiere shoulder strap.

BRIEF DESCRIPTION OF THE DRAWINGS

The objects and advantages of the present invention will become more apparent from the following detailed description of the present invention, in conjunction with the accompanying drawings wherein.

DETAILED DESCRIPTION OF THE INVENTION

Figure 1:
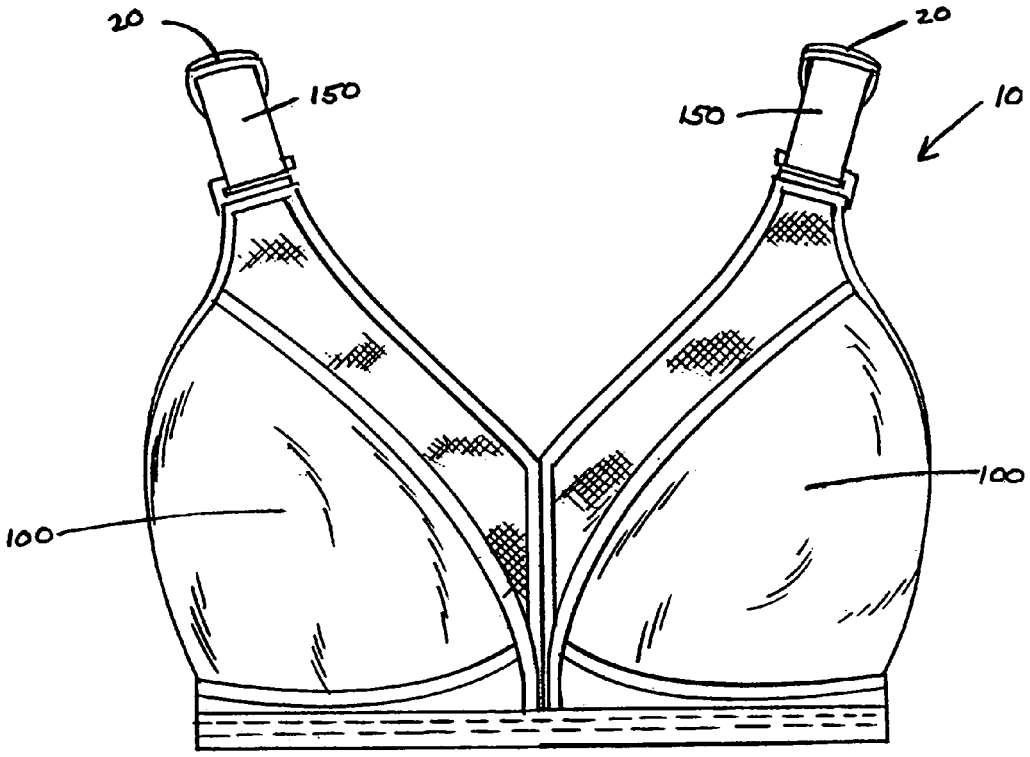
FIG. 1 is a front view of a brassiere having a pair of the brassiere straps each incorporating the shoulder strap pad of the present invention.
Figure 2:
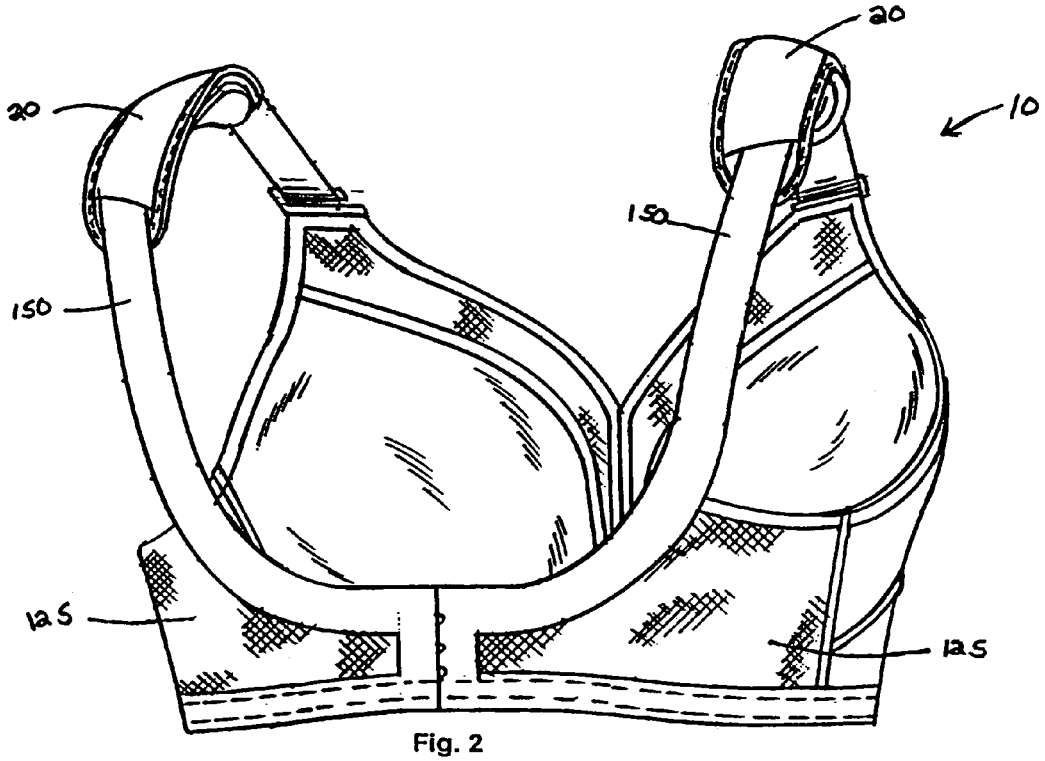
FIG. 2 is a rear perspective view of the brassiere of FIG. 1.

Referring to the figures and, in particular, FIG. 1, there is provided a brassiere generally represented by reference numeral 10. Brassiere 10 has a pair of breast cups 100 and a pair of shoulder straps 150. Each shoulder strap 150 has positioned thereon, as shown more clearly in FIGS. 3 and 4, a shoulder strap pad 20 of the present invention. As seen in FIG. 2, brassiere 10 also has a pair of back panels 125 each connected to a separate one of the pair of breast cups 100.

Figure 3:
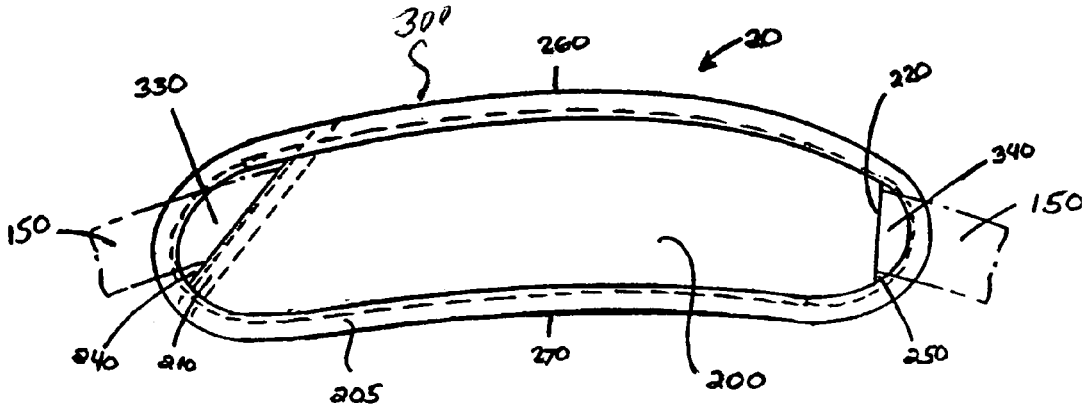
FIG. 3 is a top view of the shoulder strap pad of FIG. 1.
Figure 5:
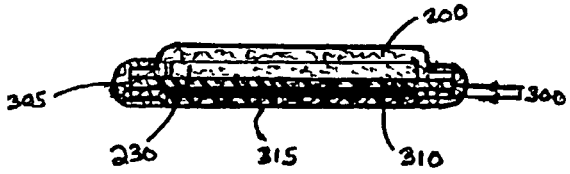
FIG. 5 is a cross-sectional-view of the shoulder strap pad taken along lines 5—5 of FIG. 4.

As shown in FIG. 3, shoulder strap pad 20 is made of a pad assembly 300 and a fabric cover 200. Pad assembly 300 is connected to fabric cover 200 by a binder 205. As shown in FIG. 5, the attachment of pad assembly 300 to fabric cover 200 form a channel 230 in which brassiere strap 150 is positioned.

Figure 6:
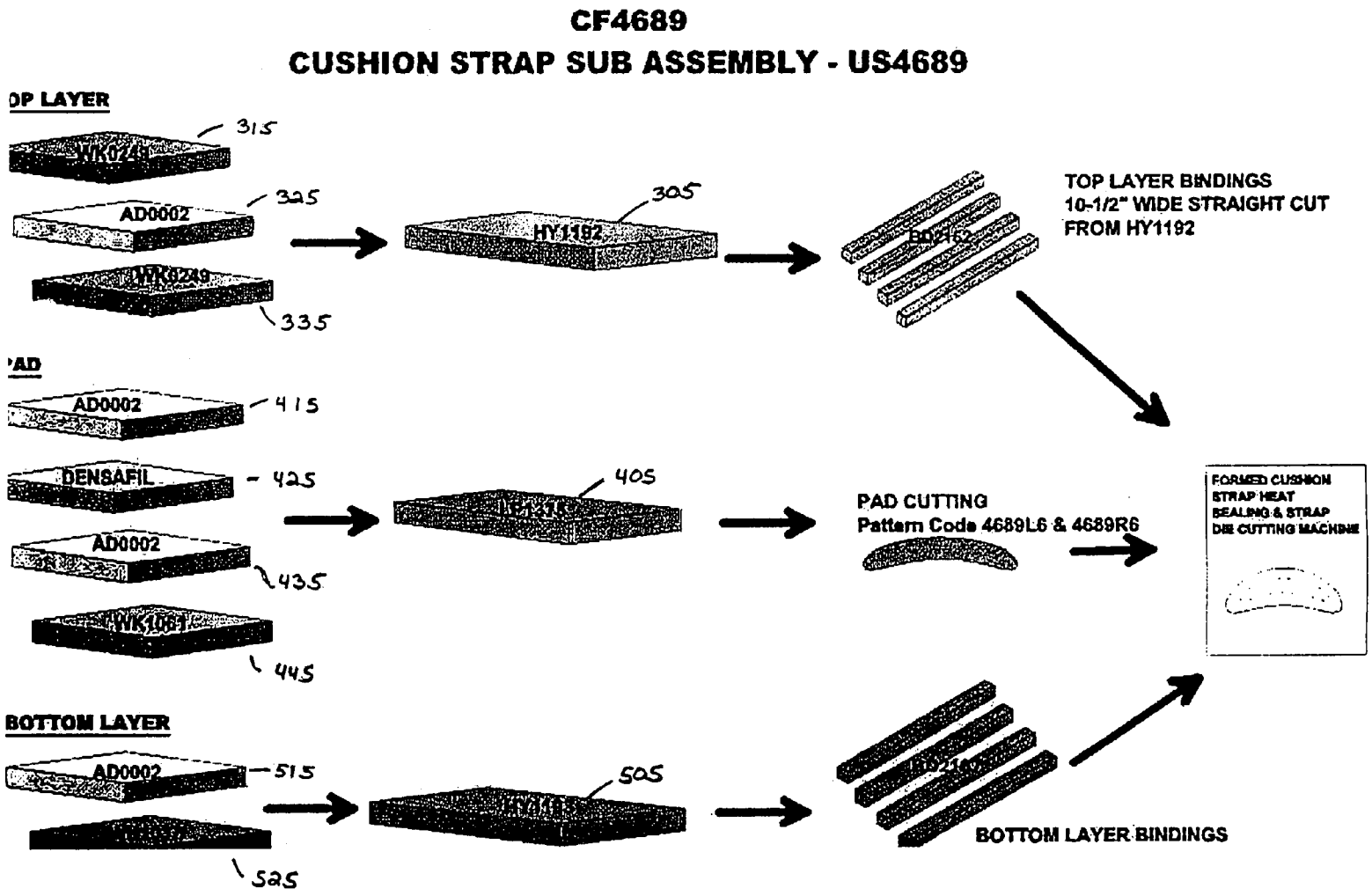
FIG. 6 is a schematic drawing of the breakdown of the components of the shoulder strap pad of FIGS. 3 and 4.

Referring to FIG. 6, pad assembly 300 includes nine layers of material and adhesive. These nine layers can be broken-down into three portions, namely a top cover 305, a bottom cover 505, and a cushion filler 405 that is positioned between the top and bottom covers. In an alternative embodiment, the number of layers of material and adhesive may vary depending upon the needs of the brassiere manufacturer.

Top cover 305 includes a first top fabric layer 315, a first adhesive web layer 325 and a first base layer 335. Top fabric layer 315 is positioned on one side of first adhesive web layer 325, while first base layer 335 is positioned on the side of first adhesive web layer 325 opposite that of first top fabric layer 315. First top fabric layer 315 and first base layer 335 are made of a one hundred percent nylon yarn. Preferably, top fabric layer 315 and first base layer 335 are made of a three bar tricot or knit marquisette fabric.

First adhesive web layer 325 is not merely adhesive, but is a fibrous sheet of adhesive web. A web of adhesive is desired since it will readily migrate into adjacent layers, such as top fabric layer 315 and first base layer 335, during the lamination process. In the preferred embodiment, first adhesive web layer 325 is made of any adhesive nylon web that is one hundred percent polyamide adhesive net. It has a fusing temperature range of 200 to 230 degrees Fahrenheit. This material can withstand washing and dry cleaning when heavier amounts of adhesive are used. This adhesive web, as used in top layer 305, bottom layer 505, and cushion filler 405 of pad assembly 300, is about 0.6 ounces per square yard (oz./sq.yd.).

Bottom cover 505 includes a second base layer 525 and a second adhesive web layer 515. Second web adhesive layer 515 is positioned on one side of second base layer 525, while the opposite side of second base layer 525 forms the outer or bottom part of the strap that contacts the skin of the wearer. Second base layer 525 is made of one hundred percent polyester fleece. Preferably, second base layer 525 is made of a two bar tricot knit fabric. Second adhesive web layer 515 is preferably identical in composition to first adhesive web layer 325.

Cushion filler 405 has a cushion layer 425, a third adhesive web layer 415, a fourth adhesive web layer 435, and third base layer 445. Cushion layer 425 is positioned between third adhesive web layer 415 and fourth adhesive web layer 435. Third adhesive web layer 415 and fourth adhesive web layer 445 are preferably identical in composition to first adhesive web layer 325. Third base layer 445 is positioned on the side of fourth adhesive web layer 435 opposite that of cushion layer 425. Third base layer 445 is made of 100 percent polyester. Preferably, third base layer 445 is made of mesh. Cushion layer 425 is made of Densafil©, a one hundred percent polyester non-woven fiber web.

Thus, in the preferred embodiment of the present invention, the pad assembly includes the following layers in sequential order from the top of the brassiere strap: first top fabric layer 315, first adhesive web layer 325, first base layer 335, third adhesive web layer 415, cushion layer 425, fourth adhesive, web layer 435, third base layer 445, second adhesive web layer 515, and second base layer 525.

Shoulder strap pad 20 is made by laminating the various components together using the following method. First top fabric layer 315, first adhesive web layer 325, and first base layer 335 are laminated together to form top cover 305 of pad assembly 300. Second adhesive layer 515 and second base layer 525 are laminated together to form bottom cover of 505 of pad assembly 300. Top cover 305 and bottom cover 505 are then laminated together by heat and adhesive to form an enclosure that receives cushion filler 405.

This combination of material and adhesive in the shoulder strap pad of the present invention create a shoulder strap pad that provides relief from the normal discomfort associated with shoulder straps, while maintaining the desired aesthetic appearance even after repeated machine washings.

Figure 4:
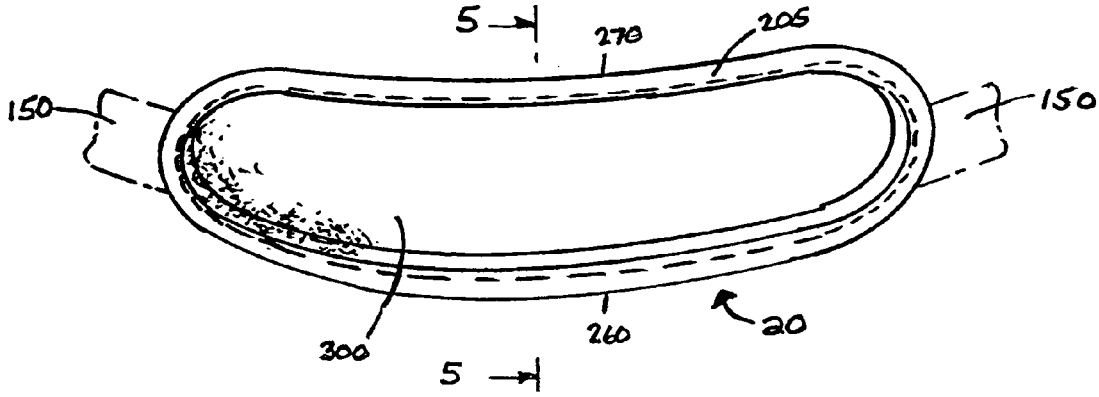
FIG. 4 is a bottom view of the shoulder strap pad of FIG. 1.

Shoulder strap pad 20 is preferably in the shape of an elongated oval. More preferably, shoulder strap pad 20 is kidney shaped. The shape of shoulder strap pad 20 deviates from the vertical plane created by a conventional brassiere strap. This deviation permits the shoulder strap pad 20 to fit, as desired, in accordance with the contour or anatomy of the shoulder of the wearer. Referring to FIGS. 3 and 4, shoulder strap pad 20 has an outer curve 260 and an inner curve 270. Shoulder strap pad 20 is positioned on the shoulder of a wearer such that outer curve 260 is directed toward the wearer's neck. This allows shoulder strap pad 20 to conform to the shape of the wearer's shoulder.

Fabric cover 200 has a first end 210 directed toward the front of brassiere 10, and thus breast cups 100, and a second end 220 directed toward back panel 125. First end 210 of fabric cover 200 is cut along a diagonal so as to provide a larger than normal front opening 240 for receipt of shoulder strap 150. Shoulder strap 150 does not consume all of front opening 240 so that it moves easier through the front opening. Thus, front opening 240 facilitates easier movement of shoulder strap pad 20 along shoulder strap 150.

Preferably, first end 210 of fabric cover 200 is cut at an acute angle with respect to the axis of shoulder strap 150. This angle is about 35 degrees to about 45 degrees, and preferably about 40 degrees. The diagonal may be angled either toward or away from the breast of the wearer.

In this embodiment, rear end 220 of fabric cover 200 is cut in a line that is almost perpendicular to the axis of shoulder strap 150. Accordingly, rear end 220 creates a rear opening 250 with pad assembly 300 that is sized, as shown in FIG. 3, so that there is very little space on either side of shoulder strap 150. Accordingly, rear opening 250 acts as a guide for shoulder strap 150. With front opening 240 and rear opening 250, fabric cover 200 does not cover portion 330, 340 of pad assembly 300. Accordingly, portions 330, 340 act as surfaces that absorb the initial movement of shoulder strap 150 through shoulder strap pad 20 and, thus avoids frictionally contacting the wearer's shoulder. Since shoulder strap pad 20 is movably positionable along the axis of shoulder strap 150, shoulder strap pad 20 can be positioned anywhere along the shoulder of the wearer to provide the maximum amount of comfort to the wearer.

The present invention having been thus described with particular reference to the preferred forms thereof, it will be obvious that various changes and modifications may be made therein without departing from the spirit and scope of the present invention as defined in the appended claims.

What is claimed is:

1. A brassiere shoulder strap pad assembly comprising:

a first top fabric layer having a first side and a second side, a first adhesive web layer having a first side and a second side, said second side of said first top fabric layer being positioned on said first side of said first adhesive web layer, said second side of said first adhesive web layer being positioned on a first base layer;

a second adhesive web layer having a first side and a second side, said second side of second adhesive web layer being positioned on a second base layer;

a cushion filler having a third adhesive web layer, a cushion layer, a fourth adhesive web layer, and a third base layer, said third adhesive web layer, said cushion layer, said fourth adhesive web layer, and said third base layer each having a first side and a second side, said second side of said third adhesive web layer being positioned on said first side of said cushion layer, said second side of said cushion layer being positioned on said first side of said fourth adhesive web layer, said second side of said fourth adhesive web layer being positioned on a third base layer, wherein said pad assembly is laminated together by heat and adhesive.

* * * * *

UNITED STATES PATENT AND TRADEMARK OFFICE

CERTIFICATE OF CORRECTION

PATENT NO. : 7,086,926 B2
APPLICATION NO. : 10/702103
DATED : November 5, 2003
INVENTOR(S) : Gloria Falla It is certified that error appears in the above-identified patent and that said Letters Patent is hereby corrected as shown below:

On The Title Page, Item (73)

Assignee: Delete "Playtex Products Inc, Westport, Connecticut" replace with --Sara Sara Lee Corporation, Winston-Salem, North Carolina--

Signed and Sealed this

Twenty-eighth Day of August, 2007

JON W. DUDAS
*Director of the United States Patent and Trademark Office*

UNITED STATES PATENT AND TRADEMARK OFFICE

CERTIFICATE OF CORRECTION

PATENT NO. : 7,086,926 B2
APPLICATION NO. : 10/702103
DATED : August 8, 2006
INVENTOR(S) : Gloria Falla It is certified that error appears in the above-identified patent and that said Letters Patent is hereby corrected as shown below:

On The Title Page, Item (73)

Assignee: Delete "Playtex Products Inc, Westport, Connecticut" replace with --Sara Sara Lee Corporation, Winston-Salem, North Carolina--

This certificate supersedes Certificate of Correction issued August 28, 2007.

Signed and Sealed this

Second Day of October, 2007

JON W. DUDAS
*Director of the United States Patent and Trademark Office*